US005480855A

United States Patent [19]

Dombrowski et al.

[11] Patent Number: 5,480,855

[45] Date of Patent: Jan. 2, 1996

[54] THERMOGRAPHIC RECORDING FILM INCLUDING IMPROVED WASHCOAT

[75] Inventors: Edward J. Dombrowski, Bellingham; Robert L. Jones, Dracut, both of Mass.

[73] Assignee: Polaroid Corporation, Cambridge, Mass.

[21] Appl. No.: 193,223

[22] Filed: Feb. 8, 1994

Related U.S. Application Data

[63] Continuation-in-part of Ser. No. 161,146, Dec. 2, 1993, abandoned.

[51] Int. Cl.[6] ..... B41M 5/40

[52] U.S. Cl. ..... 503/207; 503/200; 503/210; 503/217; 503/224; 503/226

[58] Field of Search ..... 503/200, 207, 503/210, 214, 217, 220, 224, 226, 216; 427/152

[56] References Cited

U.S. PATENT DOCUMENTS

| | | | |
|---|---|---|---|
| 4,480,003 | 10/1984 | Edwards et al. | 428/329 |
| 4,570,169 | 2/1986 | Kasamatsu et al. | 346/200 |
| 4,583,103 | 4/1986 | Hayashi et al. | 346/209 |
| 4,711,816 | 12/1987 | Wittnebel | 428/412 |
| 4,820,682 | 4/1989 | Shimomura et al. | 503/207 |
| 4,898,849 | 2/1990 | Kang | 503/214 |
| 4,904,572 | 2/1990 | Dombrowski et al. | 430/332 |
| 4,970,309 | 11/1990 | King | 544/278 |
| 4,985,394 | 1/1991 | Mori et al. | 503/226 |
| 5,028,725 | 7/1991 | King | 556/113 |
| 5,196,297 | 3/1993 | Dombrowski et al. | 430/338 |
| 5,198,406 | 3/1993 | Mack et al. | 503/207 |
| 5,220,036 | 6/1993 | King | 549/52 |
| 5,278,127 | 1/1994 | Dombrowski et al. | 503/207 |

FOREIGN PATENT DOCUMENTS

| | | | |
|---|---|---|---|
| 0250558 | 2/1990 | European Pat. Off. | 503/226 |
| 0521423 | 1/1993 | European Pat. Off. | B41M 5/40 |
| 3435513 | 4/1985 | Germany | B41M 5/18 |
| 62-270382 | 11/1987 | Japan | B41M 5/40 |
| 62-264990 | 11/1987 | Japan | B41M 5/40 |
| 2210702 | 6/1989 | United Kingdom | 503/226 |

*Primary Examiner*—Pamela R. Schwartz
*Attorney, Agent, or Firm*—Edward W. Black

[57] ABSTRACT

This invention relates to thermographic recording films including both a topcoat and a washcoat. The washcoat comprises at least one quaternary ammonium salt including at least one hydroxyl functional group, and a compound containing at least two epoxide moieties. The subject washcoat, in conjunction with the topcoat, reduces printer head build-up and streaking of the printed image film while simultaneously increases the anti-stat and slip properties of the film.

31 Claims, No Drawings

THERMOGRAPHIC RECORDING FILM INCLUDING IMPROVED WASHCOAT

CROSS-REFERENCE TO RELATED APPLICATION

This application is a continuation-in-part of application Ser. No. 08/161,146, filed Dec. 2, 1993, now abandoned.

BACKGROUND OF THE INVENTION

1. Field of the Invention

The present invention relates to thermographic recording films including a washcoat. The subject washcoat comprises a compound containing at least two epoxide moieties and a quaternary ammonium salt including at least one hydroxyl functional group.

2. Description of the Related Art

Thermographic recording films are well known in the art. Examples of such films are disclosed in U.S. Pat. No. 5,278,127 to Dombrowski and McPherson, U.S. Ser. No. 08/179,516, U.S. Pat. No. 4,904,572 to Dombrowski, Jr. et al. and U.S. Pat. No. 5,198,406 to Mack et al., all assigned to the assignee of the subject invention. Such films comprise multi-layered elements which include a support carrying a image-forming system and a protective topcoat layer positioned thereover. The image-forming system of such films includes a di- or triarylmethane thiolactone dye precursor, a Lewis acid material, an organic acidic material, and a binder. The image-forming systems of such films are well known and are described in the aforementioned prior art patents along with U.S. Pat. Nos. 4,970,309 and 5,220,036 both to King, and U.S. Pat. No. 5,196,297 to Dombrowski, Jr. et al., and European Application No. 250,558 to Dombrowski, all of which are assigned to the assignee of the subject invention.

The topcoat of such films comprise a layer or layers coated upon the image-forming system for protecting the system from mechanical wear, e.g. "gouging". "Gouging" results in actual depressions or indentations in the recording film which can be either continuous or intermittent. Gouging is believed to be caused by high temperatures, pressure and/or sticking. The topcoat must additionally permit heat to pass therethrough, and in certain applications, must be transparent. Topcoats typically include a binder, silica, lubricants, and are generally at least 1 micron thick. By way of example, U.S. Pat. No. 4,898,849 to Kang discloses a thermographic film including a crosslinked protective topcoat having fluorocarbon lubricants thereon.

In addition to topcoats, washcoats may also be utilized with such films. Washcoats are layers coated upon the topcoat to enhance topcoat properties, particularly surface properties.

A variety of challenges are encountered with such thermographic recording films. In addition to gouging as described above, head build-up and streaking are common problems. "Head build-up" is the build-up of components of the thermographic recording film on the thermal print head. Head build-up can cause streaking in the printed image, decreased image density with continued printing and damage to the thermal print head. Head build-up can become so pronounced, particularly when a lubricant, e.g. polytetrafluoroethylene, is present in the topcoat, that it appears as "spider webs" on the thermal media and printer.

"Streaking" is believed to be the result of the insulating effect of head build-up on the printing element(s) of the thermal print head which interferes with printing causing linear cross-web non-uniformity ("streaking") in the printed image.

The presence of a lubricant in the topcoat is generally desired to impart slip characteristics and to decrease gouging of the printed image, however, head build-up usually becomes more pronounced when a lubricant, e.g. polytetrafluoroethylene, is used in the topcoat. Generally, the greater the concentration of lubricant, the greater the degree of head build-up.

In addition to gouging, streaking, and head build-up, the films as described typically have problems associated with static energy charge build-up. In this regard, many known anti-stats may be used for reducing static energy charge build-up. Such anti-stats include quaternary ammonium salts which are typically compounded into the supports of such films (typically referred to as "bulk anti-stat") or provided as a separate layer adjacent to the support. For example, U.S. Pat. No. 4,711,816 to Wittnebel discloses a sheet material for an electrostatic copier which includes a layer of electrically conductive material. The conductive material may include long chain amines, amides and quaternary ammonium salts such as stearamidopropldimethyl-beta-hydroxyethylammonium nitrate (CYASTAT SN). Similarly, U.S. Pat. No. 4,480,003 to Edwards et al. discloses sheet material for electrostatic copiers which include a conductive layer for dissipating electrical charge build-up. The conductive material may include materials such as epoxy silane/silane sulfonate resin.

SUMMARY OF THE INVENTION

The present invention is a thermographic recording film comprising a support carrying:

(a) an image-forming system;

(b) a protective topcoat layer positioned adjacent the image-forming system and comprising: at least one colloidal silica, and a binder; and (c) a washcoat layer positioned adjacent the topcoat layer opposite the image-forming system, the washcoat layer comprising: a compound containing at least two epoxide moieties and at least one quaternary ammonium salt including at least one hydroxyl functional group.

The subject washcoat, in conjunction with the topcoat, unexpectedly reduces head build-up on the thermal print head and streaking of the printed image film while simultaneously increases the slip and antistat properties of the film.

It is, therefore, among the objects of the present invention to provide thermographic recording materials.

DETAILED DESCRIPTION OF THE INVENTION

The thermographic recording films according to the present invention comprise a support carrying:

(a) an image-forming system;

(b) a protective topcoat layer positioned adjacent the image-forming system and comprising: at least one colloidal silica, and a binder; and (c) a washcoat layer positioned adjacent the topcoat layer opposite the image-forming system, the washcoat layer comprising: a compound containing at least two epoxide moieties and at least one quaternary ammonium salt including at least one hydroxyl functional group.

Preferably, the subject washcoat includes a plurality of quaternary ammonium salts, each of which includes a fatty acid chain, as will be discussed hereinbelow.

The thermographic recording films of the present invention may include either transparent or reflective supports.

The reflective supports of the present invention may include polyethylene clad paper such as that sold by Glory Mill Papers Limited (type 381), Glory Paper Mill, Wooburn Green, Wylombe, Buckingham Shire, England HP10 0DB; and Baryta coated paper such as that sold by Schoeller Technical Papers Inc. (type 527), Pulaski, New York 13142-0250.

The transparent supports of the present invention include various materials known in the art. Examples of materials suitable for use as support substrates include polyesters, polycarbonates, polystyrenes, polyolefins, cellulose esters, polysulfones and polyimides. Specific examples include polypropylene, cellulose acetate, and most preferably, polyethylene terephthalate. The thickness of the support substrate is not particularly restricted, but is typically in the range of about 0.25 to 15 mils. The support substrate may be pretreated to enhance adhesion of the polymeric coating thereto.

Any image-forming system which is suitable for use in thermographic recording films may be utilized in the recording element of the present invention including dye image-forming systems, dye transfer systems and systems where an image material, e.g., a metal complex, is formed as a result of a chemical reaction between two or more system components. A number of suitable image-forming systems are known in the art. Typical suitable image-forming systems which may be incorporated in the recording element of the invention include:

A dye image-forming system wherein color-forming di- and triarylmethane dye precursors possessing certain S-containing ring closing moieties, namely a thiolactone, dithiolactone or thioether ring closing moiety, undergo coloration by contact with a Lewis acid material, preferably a metal ion of a heavy metal, particularly silver, capable of opening the S-containing ring moiety to form a colored dye metal complex.

A dye image-forming system which utilizes a class of N-substituted triarylmethane sulfonamides which undergo reversible oxidation into the colored form and reversible reduction of the oxidized form into a colorless form as disclosed in U.S. Pat. No. 5,258,279.

A dye image-forming system wherein a colorless or light-colored basic dye such as a phthalide derivative and a color developer, such as a phenol derivative, capable of causing color development upon contact with the dye are brought together in the presence of an aromatic secondary amine compound as described in U.S. Pat. No. 5,242,884.

A dye image-forming system wherein a microencapsulated colorless or light-colored electron donating dye precursor is used in combination with a color developer dissolved in an organic solvent as described in UK patent application GB 2 210 702 A.

A system which exploits redox reactions or metal complex formation reactions based on electron donor-acceptor combinations wherein at an increased temperature one of the components melts or diffuses and initiates a redox reaction to provide a colored species; typical of these systems are combinations of: (1) ferric stearate and pyrogallic acid and (2) silver behenate and a suitable reducing agent such as a phenolic compound. Various redox reactions are disclosed in *Unconventional Imaging Processes*, Focal Press Limited, 1978, page 128.

A dye diffusion thermal transfer system wherein a donor layer including a preformed image dye is arranged in combination with an image-receiving layer and an image-wise pattern of the dye is transferred to the image-receiving layer with heat and pressure. As mentioned previously, in this embodiment the protective layer is positioned on the side of the support for the donor layer which is adjacent the thermal printhead during image processing.

A system wherein a superacid is liberated from a superacid precursor and takes part in a reaction to provide a colored species as described in copending, commonly-assigned U.S. Pat. No. 5,286,612.

It will be understood that various of these systems can be practiced by separating the reactive components from one another such as by placing them in different layers of the element and subsequently causing a desired amount of one reactive component from one layer to diffuse to another layer, as a function of the amount of heat applied, to react with a second component to provide the desired image.

A particularly preferred image-forming system for use in the image recording element of the invention is that utilizing di- and triarylmethane thiolactone dye precursors as described in the aforementioned European Patent No. 250,558 and U.S. Pat. No. 5,196,297 to E. J. Dombrowski, Jr. et al. The dye precursors may be represented by the formula:

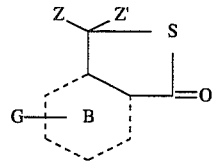

wherein ring B represents a substituted or unsubstituted carbocyclic aryl ring or rings, e.g., of the benzene or naphthalene series or a heterocyclic ring, e.g., pyridine or pyrimidine; G is hydrogen or a monovalent radical; and Z and Z' taken individually represent the moieties to complete the auxochromophoric system of a diarylmethane or a triarylmethane dye when the S-containing ring is open and Z and Z' taken together represent the bridged moieties to complete the auxochromophoric system of a bridged triarylmethane dye when the S-containing ring is open, i.e., when the ring sulfur atom is not bonded to the meso carbon atom. Usually, at least one of Z and Z' whether taken individually or together possesses as an auxochromic substituent, a nitrogen, oxygen or sulfur atom or a group of atoms containing nitrogen, oxygen or sulfur.

In a preferred embodiment, B is a benzene ring and Z and Z' taken individually or together complete the auxochromophoric system of a triarylmethane dye.

The dye precursor compounds used in this embodiment of the invention can be monomeric or polymeric compounds. Suitable polymeric compounds are those which, for example, comprise a polymeric backbone chain having dye precursor moieties attached directly thereto or through pendant linking groups. Polymeric compounds of the invention can be provided by attachment of the dye precursor moiety to the polymeric chain via the Z and/or Z' moieties or the ring B. For example, a monomeric dye precursor compound having a react-able substituent group, such as an hydroxyl or amino group, can be conveniently reacted with a monoethylenically unsaturated, polymerizable compound having a functional and derivatiz-able moiety, to provide a polymerizable monomer having a pendant dye precursor moiety. Suitable monoethylenically unsaturated compounds for this purpose include acrylyl chloride, methacrylyl chloride, methacrylic anhydride, 2-isocyanatoethyl methacrylate and 2-hydroxyethyl acrylate, which can be reacted with an appropriately substituted dye precursor compound for production of a polymerizable monomer which in turn can be polymerized in known manner to provide a polymer having the dye precursor compound pendant from the backbone chain thereof.

The thiolactone dye precursors can be synthesized, for example, from the corresponding lactones by heating substantially equimolar amounts of the lactone and phosphorus pentasulfide or its equivalent in a suitable solvent.

The binder for use in the dye image-forming system may be any of those binders described in the aforementioned European Patent No. 250,558 and the aforementioned U.S. Pat. No. 5,196,297 of E. J. Dombrowski, Jr. et al. The preferred binder is polyvinylbutyral.

The Lewis acid material used in the dye image-forming system of this embodiment of the invention may be any of the Lewis acid materials described in aforementioned European Patent No. 250,558, i.e. any Lewis acid material capable of opening a thiolactone, dithiolactone or thioether moiety. The preferred Lewis acid materials are those which are sources of silver ions, e.g. organic silver salts as described in the aforementioned European Patent No. 250,558 and U.S. Pat. No. 5,196,297 of E. J. Dombrowski, Jr. et al. Preferred silver salts are the silver salts of long chain aliphatic carboxylic acids, particularly silver behenate which may be used solely or in admixture with other organic silver salts if desired. Also, behenic acid may be used in combination with the silver behenate. Examples of other organic silver salts include silver saccharate.

The preparation of such organic silver salts is generally carried out by processes which comprise mixing a silver salt forming organic compound dispersed or dissolved in a suitable liquid with an aqueous solution of a silver salt such as silver nitrate or a silver complex salt. Various procedures for preparing the organic silver salts are described in U.S. Pat. Nos. 3,458,544, 4,028,129 and 4,273,723.

Typically the organic acidic materials of the present invention typically comprise a phenol or an organic carboxylic acid, particularly a hydroxy-substituted aromatic carboxylic acid. The preferred organic acidic material is 3,5-dihydroxybenzoic acid. Preferably, the organic acidic material is heat diffusible. A single organic acidic material can be employed or a combination of two or more may be used.

The topcoat of the subject invention is positioned adjacent the dye image-forming system and comprises at least one colloidal silica and a binder.

The present invention generally requires silicas having an average diameter of about 100 nm or less. As the size of the silica particles increases, the degree of haze tends to increase. However, larger silica particles generally increase the film's resistance to gouging, cracking, and crazing. Thus, in applications wherein haze is of less concern, e.g. reflective thermographic recording films, or where the thermal recording film is imaged and subsequently used as a photo mask to expose another material, e.g. in the production of circuit boards, diazo prints, etc., larger diameter silica particles can be used without compromising the performance of the film.

It should also be noted that the haze level may be reduced to some extent by choosing a binder which has an index of refraction substantially the same as that of the colloidal silica particles, thus reducing light scatter and resulting haze. Employing silicas having an average diameter in excess of about 50 nm results in thermographic recording films having higher levels of haze and hence films which are not as transparent. For overhead transparency (OHT) applications, it is desired that the thermographic recording films have a measured level of haze less than about 10%, and preferably less than 5%. It is preferred that the colloidal silica employed in the present invention for transparent films be at least 20 nm in diameter, unless fumed colloidal silica is used, in which case, it is preferred that the fumed colloidal silica be at least 14 nm in diameter.

As indicated, the silica employed in the topcoat of the present invention may be a fumed colloidal silica. Fumed colloidal silica is branched, three-dimensional, chain-like agglomerates of silicon dioxide. The agglomerates are composed of many primary particles which have fused together. Fumed silica is produced by the hydrolysis of silicon tetrachloride vapor in a flame of hydrogen and oxygen. The fumed colloidal silica is referred to as "fumed" silica because of its smoke-like appearance as it is formed. If fumed colloidal silica is employed, an average particle diameter in the range of about 14–100 nm is generally used, preferably about 14–15 nm for transparent thermographic recording films.

Preferable, a mixture of different sized silica particles is used, as disclosed in U.S. Pat. No. 5,198,406 to Mack et al. Such a mixture of silicas yields improved hardness and durability, thereby preventing sticking of the dye image-forming system to the thermal print head. Furthermore, such a mixture of silicas inhibits scratching on the surface of the thermographic recording film and reduces crazing, i.e., cracking on the surface of the film. A preferred mixture of silicas includes at least two colloidal silicas having different average particle diameters in the proportion, by weight, of 1 part of silica having an average diameter of about 50 nm or smaller and about 0.3 to 2.0 parts of silica particles having an average diameter no more than about 40% of the larger sized silica particles. When fumed colloidal silica is employed as the largest sized colloidal silica, it is preferred that the colloidal silicas be present in the proportion, by weight, of about 1 part of fumed colloidal silica and about 1 to 2.0 parts of silica particles having an average diameter no more than about 40% of the larger sized fumed colloidal silica particles. If fumed colloidal silica is not used, it is preferred that the mixture of silicas have different average particle diameters in the proportion, by weight, of about 1 part of silica having an average diameter of about 50 nm or smaller and about 0.3 to 1 part of silica particles having an average diameter no more than about 40% of the larger sized silica particles.

The colloidal silicas used in the present invention are produced commercially and are an aqueous colloidal dispersion of sub-micron sized silica particles in the form of tiny spheres of a specified average diameter. Preferably, the colloidal silicas are aqueous alkaline dispersions, e.g., ammonia stabilized colloidal silica. The fumed colloidal silicas used in the present invention are aqueous dispersions of fumed colloidal silica commercially available under the name Cab-O-Sperse® from Cabot Corporation, Cab-O-Sil Division, Tuscola, Ill. Colloidal silicas and fumed colloidal silicas low in sodium content are preferred since sodium can cause corrosion of the thermal print head.

The binders which can be used in the topcoats of the present invention include both water-soluble and water-insoluble binders. Poor adhesion between the topcoat layer and the dye image-forming system has been a problem when a water-soluble binder is used in the absence of the compound containing at least two epoxide moieties.

A single binder or a combination of one or more binders can be employed in the topcoats.

Examples of water-insoluble binders for use in the topcoats of the present invention include aliphatic polyurethanes, styrene-maleic anhydride copolymers, polyacrylic acid, polyacrylic latex emulsions, polyvinylidene chloride copolymer emulsions and styrene-butadiene copolymer emulsions. Examples of water-soluble binders suitable for use in the topcoats include polyvinylalcohol, polyacrylamide, hydroxyethyl-cellulose, gelatin and starch.

To prevent interaction of the components in the topcoat layer with those in the solvent soluble dye image-forming system adjacent thereto, and to ameliorate the environmental concerns associated with coating from solvents, the topcoats of the present invention are preferably coated out of aqueous systems. If the binders employed are water-insoluble, they are either coated as latex emulsions or they are made water soluble by mixing with alkali, preferably aqueous ammonia which is lost upon drying.

The topcoat preferably includes a compound containing at least two epoxide moieties, as disclosed in U.S. Pat. No. 5,278,127. The compound containing at least two epoxide moieties may be any compound containing at least two epoxide groups (also referred to herein as a "multiepoxy compound") provided that the multiepoxy compound is water soluble or water dispersible. Multiepoxy compounds found to be particularly useful in the present invention are diepoxy crosslinking compounds. Examples of suitable diepoxy crosslinking compounds include cycloaliphatic epoxides, e.g., 3,4-epoxycyclohexylmethyl-3,4-epoxycyclohexanecarboxylate, vinyl cyclohexene dioxide, 2'(3,4-epoxycyclohexyl-5,5-spiro-3,4-epoxy)cyclohexanemetadioxane and bis(3,4-epoxycyclohexyl)adipate; 1,4-butanediol diglycidyl ether; 1,2,5,6-diepoxycyclooctane; and 1,2,7,8-diepoxyoctane. When the multiepoxy compound is added in the topcoat layer, the amount employed is calculated to yield, after drying, a coated coverage in the range of about 0–100 mg/ft$^2$, and preferably about 5– 35 mg/ft$^2$. For applications wherein haze is of a particular concern, a coated coverage in the range of about 0–10 mg/ft$^2$ is preferred. In applications wherein haze is less of a concern, a coated coverage of about 22.5 mg/ft$^2$ is preferred as it generally provides improved gouging resistance.

When present in the topcoat, the multiepoxy compounds may be crosslinked with the binder and/or the silica and/or they may be crosslinked with themselves, thereby forming a binder.

The multiepoxy compounds also serve as a gas barrier. This is particularly important when using polyvinylbutyral as a binder in the dye image-forming system. Polyvinylbutyral undergoes decomposition producing butyral aidehyde, a rancid smelling compound. The multiepoxy compound provides an effective barrier to the butyral aidehyde, thus preventing the emission of odor from the film.

The ratio of total silica to multiepoxy compound and binder combined, by weight, is preferably in the range of about 2:1 to 15:1, and is more preferably about 2.5:1 to 5:1. If the ratio is smaller than about 2:1, there is too little silica present so that some sticking may occur. However, if the ratio exceeds about 15:1, the integrity of the film tends to be compromised, e.g. crazing and/or cracking of the film may occur.

The coating amount of the protective topcoat layer is in the range of about 100 to 400 mg/ft$^2$.

The protective topcoat preferably contains at least one lubricant, e.g. a wax, a polymeric fluorocarbon such as polytetrafluoroethylene, fatty acids, fatty acid amides, or a metal soap. The preferred lubricant is a polymeric fluorocarbon, e.g. polytetrafluoroethylene. The presence of a lubricant imparts slip characteristics to the thermographic recording film, reduces gouging of the recording film, and reduces the noise generated by printing.

Unfortunately, the addition of lubricants, such as polytetrafluoroethylene, tends to increase head build-up on the thermal print head and also exacerbates streaking of the film. The presence of the multiepoxy compound in the topcoat ameliorates head build-up and streaking. It is believed that the multiepoxy compound accomplishes this by crosslinking about the polytetrafluoroethylene, thereby preventing exudation of the polytetrafluoroethylene from the topcoat to the print head.

The protective topcoat may contain other additives provided the additives do not hinder the anti-stick function of the topcoat layer, do not damage the thermal print head or otherwise impair image quality. Such additives include surfactants, preferably nonionic surfactants and more preferably nonionic fluorosurfactants; plasticizers; ultraviolet absorbers, etc.

A preferred topcoat of the present invention comprises a mixture of two different sized colloidal silica particles wherein the largest sized colloidal silica is a fumed colloidal silica having an average particle diameter in the range of about 14–30 nm, preferably about 14–15 nm and the smaller sized colloidal silica has an average particle diameter of about 4 or 5 nm, a diepoxy crosslinking compound added in an amount calculated to yield, after drying, a coated coverage of about 5–35 mg/ft$^2$, a lubricant, preferably polytetrafluoroethylene, and a water-insoluble binder.

Fumed colloidal silica has been found to be particularly preferred in thermographic recording films which are imaged with high energy thermal printers such as Model TDU 850 commercially available from Raytheon Company, Submarine Signal Division, Portsmouth, Rhode Island and Model BX 500 commercially available from Seikosha America, Inc., Mahwah, N.J.

The thermographic recording film of the present invention further includes a washcoat layer positioned adjacent the topcoat layer opposite the dye image-forming system. The washcoat layer comprises a compound containing at least two epoxide moieties and a quaternary ammonium salt including at least one hydroxyl functional group.

The compound containing at least two epoxide moieties may be any of the compounds containing at least two epoxide groups as previously described with reference to the topcoat. Examples of suitable diepoxy crosslinking compounds include cycloaliphatic epoxides, e.g., 3,4-epoxycyclohexylmethyl-3,4epoxycyclohexanecarboxylate, vinyl cyclohexene dioxide, 2-(3,4-epoxycyclohexyl-5,5-spiro-3,4-epoxy)cyclohexanemetadioxane and bis(3,4-epoxycyclohexyl)adipate; 1,4-butanediol diglycidyl ether; 1,2,5,6-diepoxycyclooctane; and 1,2,7,8-diepoxyoctane.

The quaternary ammonium salt of the present invention is generally represented by the formula:

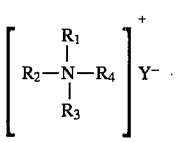

wherein $R_1$, $R_2$, $R_3$, and $R_4$ may be aliphatic such as an alkyl, branched or unbranched and substituted or unsubstituted; or cyclic, saturated (e.g. cyclohexane) or unsaturated (e.g. benzene) and may be substituted or unsubstituted; so long as at least one of $R_1$-$R_4$ includes a reactive hydroxyl group. A plurality of $R_1$-$R_4$ may collectively form a cyclic group. Preferably, at least one of $R_1$, $R_2$, $R_3$, and $R_4$ comprises a fatty acid chain, as with stearamidopropyldimethyl-B-hydroxyammonium nitrate. The term "fatty acid" is intended to include compounds having the general formula: $CH_3(CH_2)_xCOOH$ where $_x$ is generally from 4–22. The fatty acids of the present invention may be saturated or unsaturated. It is speculated that the fatty acid chain of the subject quaternary ammonium salt contributes to the enhanced slip properties of the present washcoat.

Y may be any anion which is non-deleterious to a thermal print head e.g. nitrate, sulfate, etc. Halogens are generally too deleterious to be used in the subject invention. Nitrate is the preferred anion.

Examples of quaternary ammonium salts useful in the present invention include but are not limited to: stearamidopropyldimethyl-B-hydroxyammonium nitrate (available from Cyanamid Polymer Products Div., Wayne, N.J. as CYASTAT—SN); N,N,-bis(2-hydroxyethyl)-N-(3'-dodecyl-2-hydroxypropyl)methylammonium methosulfate (available from Cyanamid Polymer Products Div., Wayne, N.J. as CYASTAT—609); hydroxyhexadecyl dimethyl hydroxyethyl ammonium chloride (available from Henkel Canada Ltd., Montreal, Quebec, Canada as DEHYQUART E); polyethylene oxide aryl phenol (available from Henkel Corp. Organic Products Group, Textile Chemicals East, Charlotte, N.C. as DACOSPIN HS); phosphated aliphatic alcohol (available from Henkel Corp. Organic Products Group, Textile Chemicals East, Charlotte, N.C. as DACOSPIN PE-146); and glycerol monooleate (available from Unichema North America, Chicago, Ill. as PROLUBE 1407).

The washcoat may include a lubricant, e.g. polytetrafluoroethylene. Various other additives may also be included within the washcoat, as is well known to those skilled in the art.

Based upon the resulting properties of the washcoat and due to the presence of a functional hydroxyl group and an epoxide moiety, it is believed that a chemical link is formed by way of reaction of the functional hydroxyl group of the quaternary salt and an epoxide moiety of the multiepoxy compound. It is further believed that due to this chemical link, the quaternary ammonium salt remains in the washcoat over prolonged durations thereby maintaining the aforementioned benefits overtime, e.g. reduced head build-up and streaking, and increased anti-stat and slip properties.

Furthermore, if a multiepoxy compound is used in the topcoat, it is believed that a crosslinked matrix is formed between the multiepoxy compound, the binder, and the silica of the topcoat in which the quaternary ammonium salt may be incorporated, thereby further assisting in anchoring the quaternary ammonium salt to the topcoat and washcoat.

The presence of a lubricant, while often desirable to impart slip characteristics and to decrease gouging, generally increases head build-up. As mentioned earlier, head build-up can cause streaking in the printed image, density degradation over time with continued printing and damage to the thermal print head. The subject washcoat unexpectedly reduces head build-up on the thermal printer head and streaking on the imaged film, as demonstrated by the Examples provided hereinbelow. Once again, it is believed that the subject washcoat accomplishes this by forming a crosslinked network between the quaternary ammonium salt and the multiepoxy compound which prevents lubricant, e.g. polytetrafluoroethylene, from passing thereby and onto the thermal print head. The reduction in head build-up is particularly advantageous when a lubricant is employed in the topcoat.

In addition to the above, the presence of the multiepoxy compound and quaternary ammonium salt unexpectedly increases slip properties and significantly reduces the noise of printing.

The multiepoxy compound added to the washcoat is added as an aqueous solution or an aqueous dispersion and the amount of multiepoxy compound employed is calculated to yield, after drying, a coated coverage in the range of about 5–50 mg/ft$^2$, preferably about 10 mg/ft$^2$. Generally, a surfactant is added to the aqueous solution or dispersion of the multiepoxy compound to be coated over the topcoat layer. The amount of surfactant used is added in an amount calculated to yield, after drying, a coated coverage of about 2–5 mg/ft$^2$.

Preferably, a silicone dispersion is also added to the washcoat to enhance slip properties to the washcoat.

Where a multiepoxy compound is present in both the topcoat and washcoat, the same or two different multiepoxy compounds may be used.

The presence of the multiepoxy compound in the washcoat results in stronger, more robust protection without substantial impact on the level of haze. It is noted however, that haze may accompany the use of a multiepoxy compound in the topcoat. Such haze is generally a function of the relative concentration of the multiepoxy compound in the topcoat and the particular type of silica used. However, the presence of a multiepoxy compound in the topcoat generally reduces head build-up and streaking. Such factors should be considered in preparing a thermographic film for particular applications.

The present invention is illustrated by the following thirty six examples. The following examples represent recording elements prepared by coating various washcoat formulations (except for Example 29 which has no washcoat) according to the present invention over the identical imaging system and topcoat.

The imaging system employed in each of the examples was prepared by coating Layer One (as described below) onto a transparent 2.65 mil polyethylene terephthalate substrate pretreated with a solvent adherable subcoat (ICI 505, commercially available from ICI Americas, Inc., Wilmington, Del.) by the slot method, followed by air drying. Layer Two (as described below) was then coated on top of Layer One in the same manner and air dried. It will be appreciated that while slot coating was employed, any appropriate coating method could be used, e.g. spray, air knife, gravure, silkscreen or reverse roll. Both Layer One and Layer Two were coated from a solvent mixture comprised of 80% of methyl ethyl ketone and 20% of methyl propyl ketone. The amounts of components used in each of the layers were calculated to give, after drying, the indicated coated coverages.

| | Coverage (mg/ft$^2$) |
|---|---|
| Layer One: | |
| Polyvinylbutyral (Butvar B-72, available from Monsanto, St. Louis, Mo.) | 386 |
| 3,5-Dihydroxybenzoic acid | 80 |
| Layer Two: | |
| Polyvinylbutyral (Butvar B-76, available from Monsanto, St. Louis, Mo.) | 475 |
| *Silver behenate dispersion | 156 (as silver behenate) |
| Blue Dye Precursor | 1 |
| Red Dye Precursor | 2 |
| Black Dye Precursor | 50 |

-continued

Blue Dye Precursor

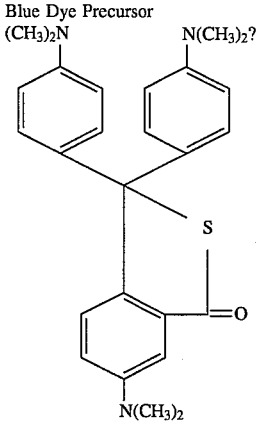

Red Dye Precursor

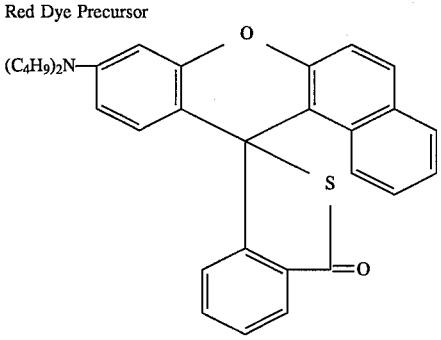

Black Dye Precursor

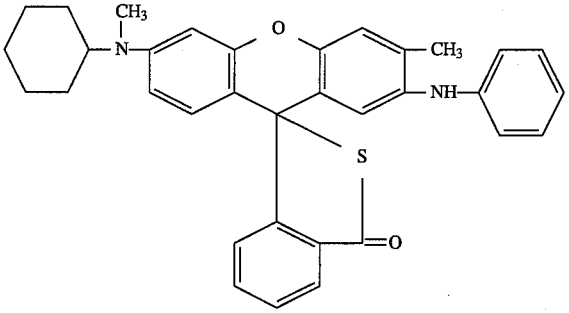

*The silver behenate dispersion was prepared according to the procedure described on page 29 of the aforementioned European Patent No. 250,558 of E. J. Dombrowski, Jr. et al.

Each of the following examples describe a topcoat and washcoat formulation which was prepared and coated, either as an aqueous dispersion or as an aqueous solution, over the above described imaging system. Each topcoat and washcoat was prepared by adding the below listed constituents in the order as listed while simultaneously stirring the mixture. The topcoat of each example consisted of substantially identical compositions, each consisting of approximately 10–15% total solids within an aqueous dispersion/solution. The washcoat for the examples consisted of approximately 1– 2% total solids within an aqueous dispersion/solution. The amount of each component used in each topcoat and washcoat formulation was calculated to give the indicated coated coverages.

| | COVERAGE mg/ft. sq. |
|---|---|
| EXAMPLE 1 TOPCOAT | |
| NALCO 2326, 5 nm Silica dispersion (17% total solids, available from Nalco Chemical Co.) | 90 |
| CAB-O-SPERSE A205 (a fumed colloidal silica having an average particle diameter of 14 nm, available from Cabot Corporation, Cab-O-Sil Division, Tuscola, IL) | 90 |
| NEOREZ R-966 Polyurethane Latex (33% total solids, available from ICI Resins, Wilmington, MA) | 28 |
| ZONYL FSN, Perfluoroalkylpolyethylene oxide non-ionic surfactant available from DuPont, Wilmington, DE | 5 |
| HOSTAFLON 5032, polytetrafluoroethylene dispersion (60% total solids, available from Hoechst-Celanese, Scutum, NJ) | 3.5 |
| 1,4-Butanediol diglycidyl ether - Commercially available as Araldite DY-026-SP from Ciba-Geigy Ltd. (Plastics Division) | 22.5 |
| EXAMPLE 1 WASHCOAT | |
| CYASTAT - SN (Stearamidopropyldimethyl-B-hydroxyethylammonium nitrate) 50% total solids available from Cyanamid Polymer Products Div., Wayne, NJ | 0 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 2 WASHCOAT Coated over topcoat described in Example 1 | |
| CYASTAT - SN (Stearamidopropyldimethyl-B-hydroxyethylammonium nitrate) 50% total solids available from Cyanamid Polymer Products Div., Wayne, NJ | 5 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 3 WASHCOAT Coated over topcoat described in Example 1 | |
| CYASTAT - SN (Stearamidopropyldimethyl-B-hydroxyethylammonium nitrate) 50% total solids available from Cyanamid Polymer Products Div., Wayne, NJ | 10 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |

-continued

| | COVERAGE mg/ft. sq. |
|---|---|
| 1,4-Butanediol diglycidyl ether - Commercially available as Araldite DY-026-SP from Ciba-Geigy Ltd. (Plastics Division) | 10 |
| EXAMPLE 4 WASHCOAT Coated over topcoat described in Example 1 | |
| CYASTAT - SN (Stearamidopropyldimethyl-B-hydroxyethylammonium nitrate) 50% total solids available from Cyanamid Polymer Products Div., Wayne, NJ | 15 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 5 WASHCOAT Coated over topcoat described in Example 1 | |
| CYASTAT - SN (Stearamidopropyldimethyl-B-hydroxyethylammonium nitrate) 50% total solids available from Cyanamid Polymer Products Div., Wayne, NJ | 20 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 6 WASHCOAT Coated over topcoat described in Example 1 | |
| CYASTAT - SN (Stearamidopropyldimethyl-B-hydroxyethylammonium nitrate) 50% total solids available from Cyanamid Polymer Products Div. Wayne, NJ | 25 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 7 WASHCOAT Coated over topcoat described in Example 1 | |
| CYASTAT - SN (Stearamidopropyldimethyl-B-hydroxyethylammonium nitrate) 50% total solids available from Cyanamid Polymer Products Div. Wayne, NJ | 30 |
| LE-46 Silicone aqueous emulsion (35% total solids) Available from Union Carbide Chemicals and Plastics Co. Inc. Specialty Chemicals Div., Danbury, CT. | 2 |
| ZONYL FSN, Perfluoroalkylpolyethylene oxide non-ionic surfactant available from DuPont, Wilmington, DE | 5 |

-continued

| | COVERAGE mg/ft. sq. |
|---|---|
| 1,4-Butanediol diglycidyl ether - Commercially available as Araldite DY-026-SP from Ciba-Geigy Ltd. (plastics Division) | 10 |
| EXAMPLE 8 WASHCOAT Coated over topcoat described in Example 1 | |
| CYASTAT - SN (Stearamidopropyldimethyl-B-hydroxyethylammonium nitrate) 50% total solids available from Cyanamid Polymer Products Div. Wayne, NJ | 35 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 9 WASHCOAT Coated over topcoat described in Example 1 | |
| CYASTAT - SN (Stearamidopropyldimethyl-B-hydroxyethylammonium nitrate) 50% total solids available from Cyanamid Polymer Products Div. Wayne, NJ | 40 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| Example 10 WASHCOAT Coated over topcoat described in Example 1 | |
| CYASTAT - SN (Stearamidopropyldimethyl-B-hydroxyethylammonium nitrate) 50% total solids available from Cyanamid Polymer Products Div., Wayne, NJ | 45 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| Example 11 WASHCOAT Coated over topcoat described in Example 1 | |
| CYASTAT - SN (Stearamidopropyldimethyl-B-hydroxyethylammonium nitrate) 50% total solids available from Cyanamid Polymer Products Div. Wayne, NJ | 50 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from | 5 |

-continued

| | COVERAGE mg/ft. sq. |
|---|---|
| DuPont, wilmington, DE | |
| 1,4-Butanediol diglycidyl ether - Commercially available as Araldite DY-026-SP from Ciba-Geigy Ltd. (Plastics Division) | 10 |
| Example 12 WASHCOAT Coated over topcoat described in Example 1 | |
| CYASTAT - SN (Stearamidopropyldimethyl-B-hydroxyethylammonium nitrate) 50% total solids available from Cyanamid Polymer Products Div., Wayne, NJ | 25 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| HOSTAFLON 5032, polytetrafluoroethylene dispersion (60% total solids, available from Hoechst-Celanese, Scutum, NJ.) | 0.125 |
| 1,4-Butanediol diglycidyl ether - Commercially available as Araldite DY-026-SP from Ciba-Geigy Ltd. (Plastics Division) | 10 |
| Example 13 WASHCOAT Coated over topcoat described in Example 1 | |
| CYASTAT - SN (Stearamidopropyldimethyl-B-hydroxyethylammonium nitrate) 50% total solids available from Cyanamid Polymer Products Div., Wayne, NJ | 25 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| HOSTAFLON 5032, polytetrafluoroethylene dispersion (60% total solids, available from Hoechst-Celanese, Scutum, NJ) | 0.25 |
| 1,4-Butanediol diglycidyl ether - Commercially available as Araldite DY-026-SP from Ciba-Geigy Ltd. (Plastics Division) | 10 |
| Example 14 WASHCOAT Coated over topcoat described in Example 1 | |
| CYASTAT - SN (Stearamidopropyldimethyl-B-hydroxyethylammonium nitrate) 50% total solids available from Cyanamid Polymer Products Div., Wayne, NJ | 25 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| HOSTAFLON 5032, polytetrafluoroethylene dispersion (60% total solids, available from Hoechst-Celanese, Scutum, NJ.) | 0.5 |
| 1,4-Butanediol diglycidyl ether - Commercially available as Araldite DY-026-SP from Ciba-Geigy Ltd. (Plastics Division) | 10 |
| Example 15 WASHCOAT Coated over topcoat described in Example 1 | |

-continued

| | COVERAGE mg/ft. sq. |
|---|---|
| CYASTAT - SN (Stearamidopropyldimethyl-B-hydroxyethylammonium nitrate) 50% total solids available from Cyanamid Polymer Products Div. Wayne, NJ | 0 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| HOSTAFLON 5032, polytetrafluoroethylene dispersion (60% total solids, available from Hoechst-Celanese, Scutum, NJ) | 0.5 |
| 1,4-Butanediol diglycidyl ether - Commercially available as Araldite DY-026-SP from Ciba-Geigy Ltd. (Plastics Division) | 10 |
| Example 16 WASHCOAT Coated over topcoat described in Example 1 | |
| CYASTAT - 609 (N,N'-bis(2-hydroxyethyl)-N-(3'-dodecyl-2-hydroxypropyl)methylammonium methosulfate) 50% total solids available from Cyanamid Polymer Products Div., | 10 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| Example 17 WASHCOAT Coated over topcoat described in Example 1 | |
| CYASTAT - 609 (N,N'-bis(2-hydroxyethyl)-N-(3'-dodecyl-2-hydroxypropyl)methylammonium methosulfate) 50% total solids available from Cyanamid Polymer Products Div., | 15 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| Example 18 WASHCOAT Coated over topcoat described in Example 1 | |
| CYASTAT - 609 (N,N'-bis(2-hydroxyethyl)-N-(3'-dodecyl-2-hydroxypropyl)methylammonium methosulfate) 50% total solids available from Cyanamid Polymer Products Div., | 20 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY- | 10 |

-continued

| | COVERAGE mg/ft. sq. |
|---|---|
| 026-SP from Ciba-Geigy Ltd. (Plastics Division) | |
| Example 19 WASHCOAT Coated over topcoat described in Example 1 | |
| CYASTAT - 609 (N,N'-bis(2-hydroxyethyl)-N-(3'-dodecyl-2-hydroxypropyl)methylammonium methosulfate) 50% total solids available from Cyanamid Polymer Products Div., | 25 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 20 WASHCOAT Coated over topcoat described in Example 1 | |
| CYASTAT - 609 (N,N'-bis(2-hydroxyethyl)-N-(3'-dodecyl-2-hydroxypropyl)methylammonium methosulfate) 50% total solids available from Cyanamid Polymer Products Div., | 30 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 21 WASHCOAT Coated over topcoat described in Example 1 | |
| DEHYQUART E (Hydroxyhexadecyl dimethyl hydroxyethyl ammonium chloride) - 28% solids from Henkel Canada Ltd., Montreal, Quebec, Canada | 10 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 22 WASHCOAT Coated over topcoat described in Example 1 | |
| DEHYQUART E (Hydroxyhexadecyl dimethyl hydroxyethyl ammonium chloride) - 28% solids from Henkel Canada Ltd., Montreal, Quebec, Canada | 15 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |

-continued

| | COVERAGE mg/ft. sq. |
|---|---|
| 1,4-Butanediol diglycidyl ether - Commercially available as Araldite DY-026-SP from Ciba-Geigy Ltd. (Plastics Division) | 10 |
| EXAMPLE 23 WASHCOAT Coated over topcoat described in Example 1 | |
| DEHYQUART E (Hydroxyhexadecyl dimethyl hydroxyethyl ammonium chloride) - 28% solids from Henkel Canada Ltd., Montreal, Quebec, Canada | 20 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 24 WASHCOAT Coated over topcoat described in Example 1 | |
| DEHYQUART E (Hydroxyhexadecyl dimethyl hydroxyethyl ammonium chloride) - 28% solids from Henkel Canada Ltd., Montreal, Quebec, Canada | 25 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 25 WASHCOAT Coated over topcoat described in Example 1 | |
| DEHYQUART E (Hydroxyhexadecyl dimethyl hydroxyethyl ammonium chloride) - 28% solids from Henkel Canada Ltd., Montreal, Quebec, Canada | 30 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 26 WASHCOAT Coated over topcoat described in Example 1 | |
| DACOSPIN HS - Polyethylene oxide aryl phenol available from Henkel Corp. Organic Products Group., Textile Chemicals East, Charlotte, NC | 25 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |

-continued

| | COVERAGE mg/ft. sq. |
|---|---|
| 1,4-Butanediol diglycidyl ether - Commercially available as Araldite DY-026-SP from Ciba-Geigy Ltd. (Plastics Division) | 10 |
| EXAMPLE 27 WASHCOAT Coated over topcoat described in Example 1 | |
| DACOSPIN PE-146_Phosphated aliphatic alcohol. Available from Henkel Corp. Organic Products Group., Textile Chemicals East, Charlotte, NC | 25 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 28 WASHCOAT Coated over topcoat described in Example 1 | |
| PROLUBE 1407 - Glycerol monooleate Available from Unichema North America, Chicago, IL | 25 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 29 NO WASHCOAT topcoat described in Example 1 | |
| EXAMPLE 30 WASHCOAT Coated over topcoat described in Example 1 | |
| CYASTAT - SN (Stearamidopropyldimethyl-B-hydroxyethylammonium nitrate) 50% total solids available from Cyanamid Polymer Products Div., Wayne, NJ | 25 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 31 WASHCOAT Coated over topcoat described in Example 1 | |
| CYASTAT - 609 (N,N'-bis(2-hydroxyethyl)-N-(3'-dodecyl-2-hydroxypropyl)methylammonium methosulfate) 50% total solids available from Cyanamid Polymer Products Div., | 25 |
| DEHYQUART E (Hydroxyhexadecyl dimethyl hydroxyethyl ammonium chloride) - 28% solids from Henkel Canada Ltd., Montreal, Quebec, Canada | 0 |

-continued

| | COVERAGE mg/ft. sq. |
|---|---|
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 32 WASHCOAT Coated over topcoat described in Example 1 | |
| CYASTAT - 609 (N,N'-bis(2-hydroxyethyl)-N-(3'-dodecyl-2-hydroxypropyl)methylammonium methosulfate) 50% total solids available from Cyanamid Polymer Products Div., | 0 |
| DEHYQUART E (Hydroxyhexadecyl dimethyl hydroxyethyl ammonium chloride) - 28% solids from Henkel Canada Ltd., Montreal, Quebec, Canada | 25 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 33 WASHCOAT Coated over topcoat described in Example 1 | |
| CYASTAT - 609 (N,N'-bis(2-hydroxyethyl)-N-(3'-dodecyl-2-hydroxypropyl)methylammonium methosulfate) 50% total solids available from Cyanamid Polymer Products Div., | 5 |
| DEHYQUART E (Hydroxyhexadecyl dimethyl hydroxyethyl ammonium chloride) - 28% solids from Henkel Canada Ltd., Montreal, Quebec, Canada | 20 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 34 WASHCOAT Coated over topcoat described in Example 1 | |
| CYASTAT - 609 (N,N'-bis(2-hydroxyethyl)-N-(3'-dodecyl-2-hydroxypropyl)methylammonium methosulfate) 50% total solids available from Cyanamid Polymer Products Div., | 10 |
| DEHYQUART E (Hydroxyhexadecyl dimethyl hydroxyethyl ammonium chloride - 28% solids from Henkel Canada Ltd., Montreal, Quebec, Canada | 15 |
| LE-46 Silicone aqueous emulsion (35% total solids) Available from Union Carbide Chemicals and Plastics Co. Inc. Specialty Chemicals Div., Danbury, CT | 2 |

-continued

| | COVERAGE mg/ft. sq. |
|---|---|
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 35 WASHCOAT Coated over topcoat described in Example 1 | |
| CYASTAT - 609 (N,N'-bis(2-hydroxyethyl)-N-(3'-dodecyl-2-hydroxypropyl)methylammonium methosulfate) 50% total solids available from Cyanamid Polymer Products Div., | 15 |
| DEHYQUART E (Hydroxyhexadecyl dimethyl hydroxyethyl ammonium chloride) - 28% solids from Henkel Canada Ltd., Montreal, Quebec, Canada | 10 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |
| EXAMPLE 36 WASHCOAT Coated over topcoat described in Example 1 | |
| CYASTAT - 609 (N,N'-bis(2-hydroxyethyl)-N-(3'-dodecyl-2-hydroxypropyl)methylammonium methosulfate) 50% total solids available from Cyanamid Polymer Products Div., | 20 |
| DEHYQUART E (Hydroxyhexadecyl dimethyl hydroxyethyl ammonium chloride) - 28% solids from Henkel Canada Ltd., Montreal, Quebec, Canada | 5 |
| LE-46 Silicone aqueous emulsion (35% total solids) Available from Union Carbide Chemicals and Plastics Co. Inc. Specialty Chemicals Div., Danbury, CT | 2 |
| ZONYL FSN, Perfluoroalkylpolyethylene oxide non-ionic surfactant available from DuPont, Wilmington, DE | 5 |
| 1,4-Butanediol diglycidyl ether - Commercially available as Araldite DY-026-SP from Ciba-Geigy Ltd. (Plastics Division) | 10 |

Each of the recording elements prepared above, were imaged by means of a Model TDU 850 direct thermal printer, commercially available from Raytheon Company, Submarine Signal Division, Portsmouth, R.I.; and a Model BX 500 direct thermal printer, commercially available from Seikosha America, Inc., Mahwah, N.J. When using a Model BX 500 printer to image, the thermographic recording media of the present invention preferably include a lubricant in the topcoat in amount to give a coated coverage after drying of 4.0 to 6.0 mg/ft$^2$. When using other high energy printers, e.g., the Model TDU 850, a lesser amount of lubricant, i.e. 0.25 to 1.0 mg/ft$^2$, is generally employed.

The streaking and the head build-up were determined for each imaged film. The results are recorded in Tables 1–3. Streaking and head build-up were each ascertained visually. It should be noted that the determinations regarding streaking and head build-up were qualitative in nature. Furthermore, the determinations provided in Tables 1–3 were based upon laboratory testing of fifty feet of printing, not commercial scale printing. As a consequence, the determinations provided are subject to some degree of variation.

For streaking, "excellent" describes those recording films for which there was no observable streaking after 50 feet of printing; "very good" describes those recording films for which there was only slight, but noticeable streaking after 50 feet of printing; "good" describes recording films for which there was moderate streaking visible after 50 feet of printing; "fair" is used to describe those recording films for which there was heavy streaking before 50 feet of printing accompanied by significant density loss; and, "poor" describes those recording films for which streaking was so severe that 50 feet of recording film could not be successfully printed—the heating elements were insulated to an extent which seriously interfered with printing.

For head build-up, "excellent" describes those situations in which there was only very slight if any head build-up on the thermal print head after 50 feet of printing; "good" describes those situations where there was a slight to moderate accumulation of material on and/or after the print elements after 50 feet of printing; "fair" describes those situations for which there was substantial accumulation of material on and/or after the print elements after 50 feet of printing; and, "poor" describes those situations in which there was an exorbitant amount of material directly on and after the print elements.

To illustrate the invention, Tables 1–3 are provided below.

TABLE 1

| EXAMPLE | HEAD BUILDUP | STREAKING |
|---|---|---|
| 1 | FAIR | GOOD |
| 2 | GOOD | EXCELLENT |
| 3 | GOOD | EXCELLENT |
| 4 | GOOD | EXCELLENT |
| 5 | GOOD | EXCELLENT |
| 6 | EXCELLENT | EXCELLENT |
| 7 | EXCELLENT | EXCELLENT |
| 8 | EXCELLENT | EXCELLENT |
| 9 | EXCELLENT | EXCELLENT |
| 10 | GOOD | EXCELLENT |
| 11 | GOOD | VERY GOOD |
| 12 | GOOD | VERY GOOD |
| 13 | GOOD | VERY GOOD |
| 14 | GOOD | VERY GOOD |
| 15 | POOR | GOOD |

Of the examples provided in Table 1, Examples 1 and 15 are controls which have been provided for comparative purposes. Examples 2–14 include various amounts of one particular quaternary ammonium salt i.e. CYASTAT—SN (Stearamidopropyldimethyl-B-hydroxyethylammonium nitrate). As indicated by the data presented in Table 1, the presence of CYASTAT—SN in combination with a multi-epoxy compound in the washcoat resulted in thermographic recording films having reduced streaking and head build-up. This is perhaps best shown by way of a comparison of Examples 1 and 2. Example 1 is a control sample comprising a film element having a washcoat with none of the subject quaternary ammonium salt (CYASTAT—SN) added thereto. Example 2 is identical to Example 1 but for the presence of a small amount (coverage equals 5 mg/ft$^2$) of CYASTAT—SN in the washcoat. As indicated in Table 1, Example 2 showed reduced streaking and head build-up.

Of the Examples provided in Table 1, Examples 6–9 showed the best results, i.e. the least amount of head build-up and streaking. The films of Examples 6–9 included washcoats having CYASTAT—SN in coverages between 25–40 mg/ft$^2$. Coverages greater than 40 mg/ft$^2$ and less than 25 mg/ft$^2$ showed improvement to a lesser extent.

Examples 12–15 demonstrate the ability of the subject invention to specifically prevent the deposition of a lubricant, polytetrafluoroethylene, upon the print head during printing. More specifically, Example 12–14 include washcoats having a coverage of 25 mg/ft$^2$ of CYASTAT—SN with increasing quantities of polytetrafluoroethylene in the washcoat, i.e. 0.125, 0.25, and 0.5 mg/ft$^2$, respectively. Example 15 includes the identical film element as Example 14 but for the lack of any of the subject quaternary ammonium salt in the washcoat. As can be seen from a comparison of Examples 14 and 15, the presence of the quaternary ammonium salt (CYASTAT—SN) in the washcoat reduced head build-up and streaking associated with the use of a polytetrafluoroethylene in the washcoat. As a consequence of the ability of the subject washcoat to reduce head build-up and streaking, lubricants such as polytetrafluoroethylene can be used in greater quantities, thereby increasing the slip properties of the film.

Table 2 is provided below to illustrate the utility of various quaternary ammonium salts within the washcoat of the subject invention.

TABLE 2

| EXAMPLE | HEAD BUILDUP | STREAKING |
|---|---|---|
| 16 | EXCELLENT | EXCELLENT |
| 17 | EXCELLENT | EXCELLENT |
| 18 | EXCELLENT | EXCELLENT |
| 19 | EXCELLENT | EXCELLENT |
| 20 | EXCELLENT | VERY GOOD |
| 21 | EXCELLENT | EXCELLENT |
| 22 | EXCELLENT | EXCELLENT |
| 23 | EXCELLENT | EXCELLENT |
| 24 | EXCELLENT | EXCELLENT |
| 25 | EXCELLENT | VERY GOOD |
| 26 | EXCELLENT | EXCELLENT |
| 27 | VERY GOOD | EXCELLENT |
| 28 | EXCELLENT | EXCELLENT |

Examples 16–28 of Table 2, all include an imaging system and topcoat as described in Example 1, with various washcoats coated thereover. Examples 16–28 each include a washcoat having one of the following quaternary ammonium salts: N,N'-bis(2-hydroxyethyl)-N-( 3'-dodecyl-2 hydroxypropyl) methylammonium methosulfate (available from Cyanamid Polymer Products Div., Wayne, N.J. as CYASTAT—609); hydroxyhexadecyl dimethyl hydroxyethyl ammonium chloride (available from Henkel Canada Ltd., Montreal, Quebec, Canada as DEHYQUART E); polyethylene oxide aryl phenol (available from Henkel Corp. Organic Products Group, Textile Chemicals East, Charlotte, N.C. as DACOSPIN HS); phosphated aliphatic alcohol (available from Henkel Corp. Organic Products Group, Textile Chemicals East, Charlotte, N.C. as DACOSPIN PE-146); and glycerol monooleate (available from Unichema North America, Chicago, Il. as PROLUBE 1407). As illustrated in Table 2, all of the salts used in Examples 16–28 performed well, that is, had minimal head buildup and streaking.

Table 3 is provided below to illustrate the utility of various combinations of quaternary ammonium salts within the washcoat of the subject invention.

TABLE 3

| EXAMPLE | HEAD BUILDUP | STREAKING |
|---|---|---|
| 29 | FAIR | FAIR |
| 30 | EXCELLENT | EXCELLENT |
| 31 | EXCELLENT | VERY GOOD |
| 32 | EXCELLENT | GOOD |
| 33 | EXCELLENT | EXCELLENT |
| 34 | EXCELLENT | EXCELLENT |
| 35 | EXCELLENT | EXCELLENT |
| 36 | EXCELLENT | EXCELLENT |

Examples 29–36 all included the same imaging system and topcoat as described with respect to Examples 1–28. Example 29, however, had no washcoat at all. Examples 30, 31 and 32 each had washcoats including equal amounts of a single ammonium salt, CYASTAT—SN (stearamidopropyldimethyl-B-hydroxyethylammonium nitrate); CYASTAT—609 (N,N'-bis(2-hydroxyethyl)-N-(3'-dodecyl-2 hydroxypropyl) methylammonium methosulfate); and DEHYQUART E (hydroxyhexadecyl dimethyl hydroxyethyl ammonium chloride, respectively. Examples 33–36 included various blends of CYASTAT–609 and DEHYQUART E. The total quantity of quaternary ammonium salt added to the washcoats of Examples 30–36 was equivalent, i.e. a coverage of about 25 mg/ft$^2$. The amount and types of quaternary ammonium salt added to the washcoats of Examples 30–36 were as follows: Example 30 included 25 mg/ft$^2$ of CYASTAT—SN; Example 31 included 25 mg/ft$^2$ of CYASTAT—609; Example 32 included 25 mg/ft$^2$ of DEHYQUART E; Example 33 included 5 mg/ft$^2$ of CYASTAT— 609 and 20 mg/ft$^2$ of DEHYQUART E; Example 34 included 10 mg/ft$^2$ of CYASTAT—609 and 15 mg/ft$^2$ of DEHYQUART E; Example 35 included 15 mg/ft$^2$ of CYASTAT—609 and 10 mg/ft$^2$ of DEHYQUART E; Example 36 included 20 mg/ft$^2$ of CYASTAT—609 and 5 mg/ft$^2$ of DEHYQUART E.

As indicated by Table 3, washcoats which included multiple quaternary ammonium salts performed better (had less head build-up and streaking) than those with equal amounts of a single quaternary ammonium salt.

Many modifications and variations of the instant invention are possible in light of the above teachings. It is therefore, to be understood that within the scope of the appended claims, the invention may be practiced otherwise than as specifically described.

We claim:

1. A thermographic recording film comprising a support carrying:

(a) a thermographic image-forming system comprising at least one layer;

(b) a protective layer positioned above said image-forming system or positioned below the surface of said support opposite that which carries said image-forming system, and comprising: at least one colloidal silica, and a binder; and (c) a washcoat layer positioned over the surface of said protective layer which is remote from said support, said washcoat layer comprising: a compound containing at least two epoxide moieties and at least one quaternary ammonium salt including at least one hydroxyl functional group.

2. A thermographic recording film according to claim 1 further characterized by said quaternary ammonium salt including a pendent fatty acid chain.

3. A thermographic recording film according to claim 2 wherein said fatty acid chain includes an amide.

4. A thermographic recording film according to claim 3 wherein said quaternary ammonium salt is stearamidopropyldimethyl-B-hydroxyammonium nitrate.

5. A thermographic recording film according to claim 1 wherein said washcoat layer further includes a lubricant.

6. A thermographic recording film according to claim 5 wherein said lubricant comprises polytetrafluoroethylene.

7. A thermographic recording film according to claim 1 wherein said washcoat layer further includes a surfactant.

8. A thermographic recording film according to claim 1 wherein said compound containing at least two epoxide moieties is a diepoxy crosslinking compound.

9. A thermographic recording film according to claim 8 wherein said diepoxy crosslinking compound is bis (3,4-epoxycyclohexyl)adipate.

10. A thermographic recording film according to claim 8 wherein said diepoxy crosslinking compound is 1,4-butanediol diglycidyl ether.

11. A thermographic recording film according to claim 1 wherein said protective layer further includes a compound containing at least two epoxide moieties.

12. A thermographic recording film according to claim 11 wherein said compound containing at least two epoxide moieties is a diepoxy crosslinking compound.

13. A thermographic recording film according to claim 12 wherein said diepoxy crosslinking compound is bis (3,4-epoxycyclohexyl)adipate.

14. A thermographic recording film according to claim 12 wherein said diepoxy crosslinking compound is 1,4-butanediol diglycidyl ether.

15. A thermographic recording film according to claim 1 wherein said protective layer includes at least two colloidal silicas having different average particle diameters.

16. A thermographic recording film according to claim 1 wherein said protective layer further includes a compound containing at least two diepoxide moleties and wherein in said protective layer the ratio of total silica to said compound containing at least two epoxide moleties [being] is at least about 2:1 by weight.

17. A thermographic recording film according to claim 1 wherein said colloidal silica is fumed colloidal silica.

18. A thermographic recording film according to claim 1 wherein said binder in said protective layer is water-insoluble.

19. A thermographic recording film according to claim 18 wherein said binder in said protective layer is an aliphatic polyurethane.

20. A thermographic recording film according to claim 1 wherein said binder in said protective layer is water-soluble.

21. A thermographic recording film according to claim 20 wherein said binder in said protective layer is polyvinylalcohol.

22. A thermographic recording film according to claim 1 wherein said protective layer includes a surfactant.

23. A thermographic recording film according to claim 1 wherein said protective layer includes a lubricant.

24. A thermographic recording film according to claim 23 wherein said lubricant is polytetrafluoroethylene.

25. A thermographic recording film according to claim 1 wherein said Lewis acid material comprises a source of silver ions.

26. A thermographic recording film according to claim 25 wherein said source of silver ions comprises an organic silver salt.

27. A thermographic recording film according to claim 26 wherein said organic silver salt is silver behenate.

28. A thermographic recording film according to claim 1 wherein said image-forming system comprises a di- or triarylmethane thiolactone dye precursor, a Lewis acid material, an organic acidic material, and a binder.

29. A thermographic recording film according to claim 1 wherein said washcoat layer includes a plurality of quaternary ammonium salts.

30. A thermographic recording film according to claim 28 wherein said organic acidic material comprises 3,5-dihydroxybenzoic acid.

31. A thermographic recording film comprising a support carrying in sequence:

(a) a thermographic image-forming system comprising at least one layer and including a di- or triarylmethane thiolactone dye precursor and an organic silver salt;

(b) a protective layer positioned above said image-forming system and comprising: at least one colloidal silica, and a binder; and (c) a washcoat layer positioned above said protective layer, said washcoat layer comprising: a compound containing at least two epoxide moieties and at least one quaternary ammonium salt including at least one hydroxyl functional group.

* * * * *

UNITED STATES PATENT AND TRADEMARK OFFICE

CERTIFICATE OF CORRECTION

PATENT NO. : 5,480,855
DATED : January 2, 1996
INVENTOR(S) : Edward J. Dombrowski and Robert L. Jones It is certified that error appears in the above-indentified patent and that said Letters Patent is hereby corrected as shown below:

Column 7, line 28, delete " 2′ " and insert --- 2– ---.

Column 9, line 15, " N,N,-bis " should be --- N,N'-bis ---.

Column 11, line 4, at the top of the right-hand side of the formula, " $N(CH_3)_2$? " should be --- $N(CH_3)_2$ ---.

Column 25, line 40 (claim 16, line 5), delete " [being] ".

Column 26, line 15 (claim 25, line 1) "1" should be --- 28 ---.

Signed and Sealed this

Eighth Day of October, 1996

Bruce Lehman

*Attest:*

BRUCE LEHMAN

*Attesting Officer*

*Commissioner of Patents and Trademarks*